United States Patent [19]

Denney

[11] Patent Number: 4,749,085

[45] Date of Patent: Jun. 7, 1988

[54] PILL BOX HOLDER

[76] Inventor: James D. Denney, 1048 Joliet Ave., Stillwater, Minn. 55082

[21] Appl. No.: 103,677

[22] Filed: Oct. 2, 1987

[51] Int. Cl.[4] ..... B65D 85/56

[52] U.S. Cl. ..... 206/534; 206/459; 206/538; 220/23.83

[58] Field of Search ..... 206/459, 528, 533, 534, 206/538, 564; 220/23.4, 23.83, 23.86

[56] References Cited

U.S. PATENT DOCUMENTS

| | | | |
|---|---|---|---|
| 2,115,021 | 4/1938 | Joffee | 206/459 |
| 3,300,055 | 1/1967 | Rohr | 206/564 |
| 3,442,378 | 5/1969 | Wolfe | 206/564 |
| 3,522,877 | 8/1970 | Phillips, Jr. | 206/564 |
| 3,589,554 | 6/1971 | Smith | 220/23.83 |
| 3,591,014 | 7/1971 | Lindgren | 206/459 |
| 3,791,549 | 2/1974 | Delbrouk et al. | 206/564 |
| 4,038,937 | 8/1977 | Moe | 206/538 |
| 4,195,059 | 3/1980 | Whitcher | 206/459 |
| 4,473,156 | 9/1984 | Martin | 206/534 |
| 4,693,371 | 9/1987 | Malpass | 206/534 |

FOREIGN PATENT DOCUMENTS

| | | | |
|---|---|---|---|
| 2150454 | 10/1972 | Fed. Rep. of Germany | 206/538 |

*Primary Examiner*—Jimmy G. Foster
*Attorney, Agent, or Firm*—Jacobson and Johnson

[57] ABSTRACT

A rectangular, open-top shallow tray with enclosing side walls has markings designating each day of the week equally spaced across the top and a set of individual compartments or pill boxes for each day of the week resting in the tray in line with each of the designated days of the week and frictionally and removably held in place in the tray so that each of the set of pill boxes can be separately and individually removed from the tray whereby the user can conveniently carry prescribed medication for a given day separate from the other days of the week.

1 Claim, 2 Drawing Sheets

PILL BOX HOLDER

FIELD OF THE INVENTION

This is a device for holding medication, usually in the form of pills or tablets or capsules, in individual compartments or pill boxes for various times of the day in each day of the week with the pill boxes for any given day being separately removable. In this way the entire week's prescribed medication can be separately removed to be easily carried by the user without need of transporting the entire week's worth of medication.

DESCRIPTION OF THE PRIOR ART

There are presently commercially available suitably marked pill box holders for containing and holding prescribed medication to be taken at certain times of the day during each day of the week as a convenience and reminder to the user as to when to take the amount of presented medication. However, in the event the user leaves his residence for the day or a portion of the day, he then leaves the medication at home or carries with him the entire week's prescribed medication or he has to remove the medication for that day from the pill box and put it in a different container that he can carry about.

SUMMARY

An outer tray having enclosing side walls along its edges has markings for each day of the week equally spaced along its top edge. A set of individualized compartments or pill boxes for holding pills or capsules or the like suitably marked for different times of the day rests in the tray in line with each of the day-of-the-week markings on the tray. Each set of pill boxes can be separately removed from the tray to be conveniently carried by the user so the days' worth of medication is available without the need to carry around the entire weeks' worth of medication or remove it from the pill box. The set of pill boxes are held frictionally but removably in the tray and extend above the height of the side walls of the tray so that it can be easily grasped and removed from the tray and then later put back in its place.

and

Figure 1:
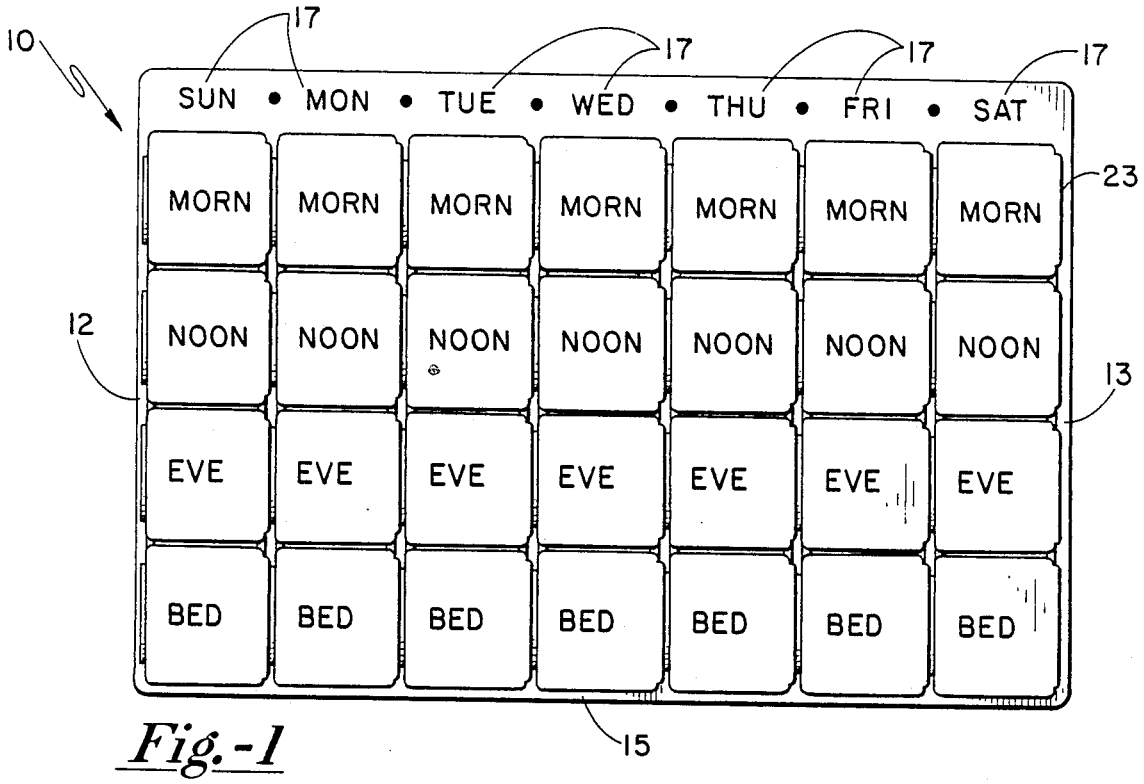
FIG. 1 is a plan view of a preferred embodiment of the invention.
Figure 2:
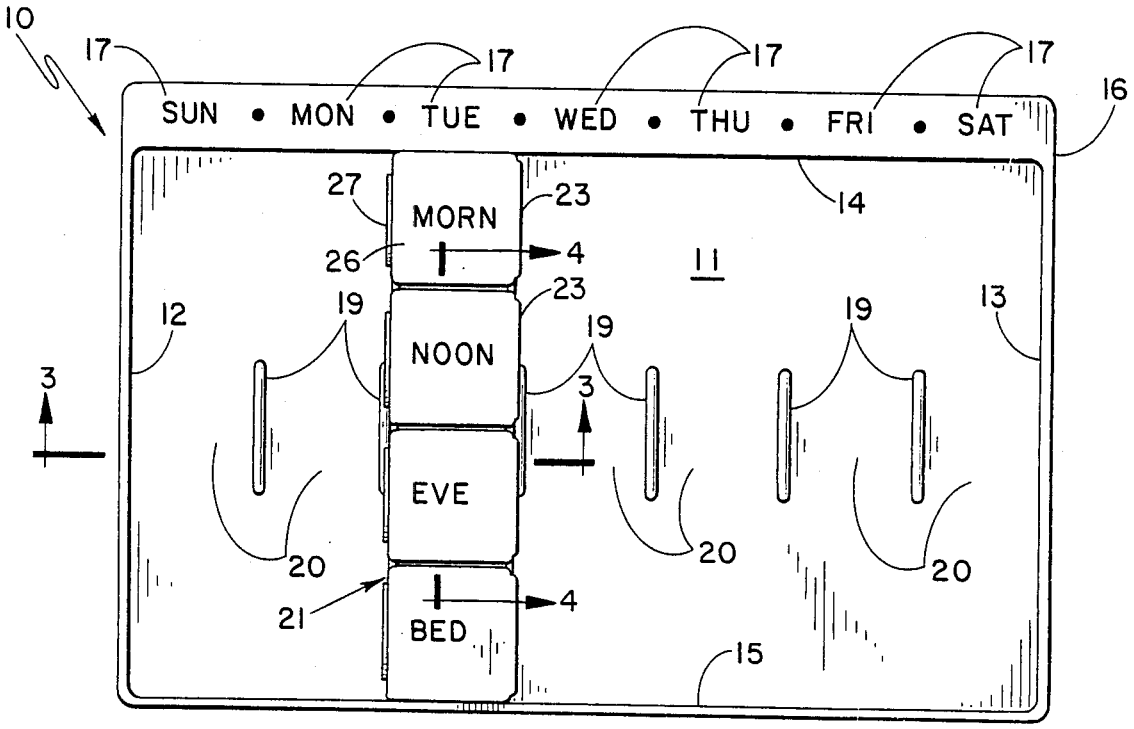
FIG. 2 is a view similar to FIG. 1 with only one set of pill boxes resting in the outer container to show the invention in greater detail.
Figure 3:
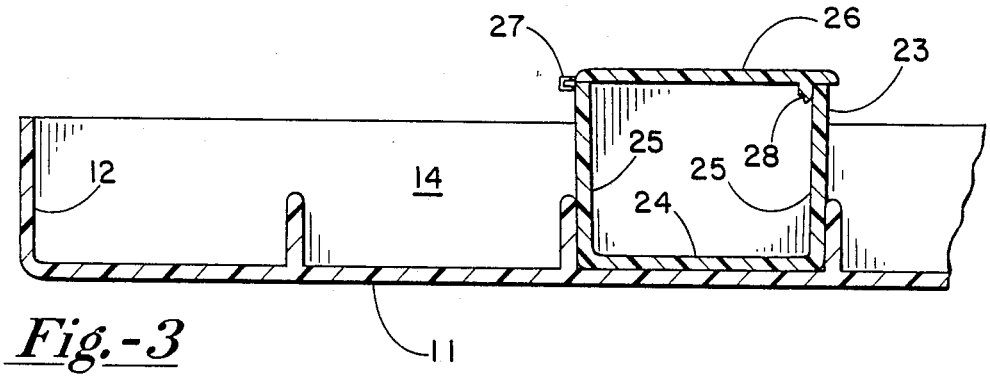
FIG. 3 is a view taken along section line 3—3 of FIG. 1.
Figure 4:
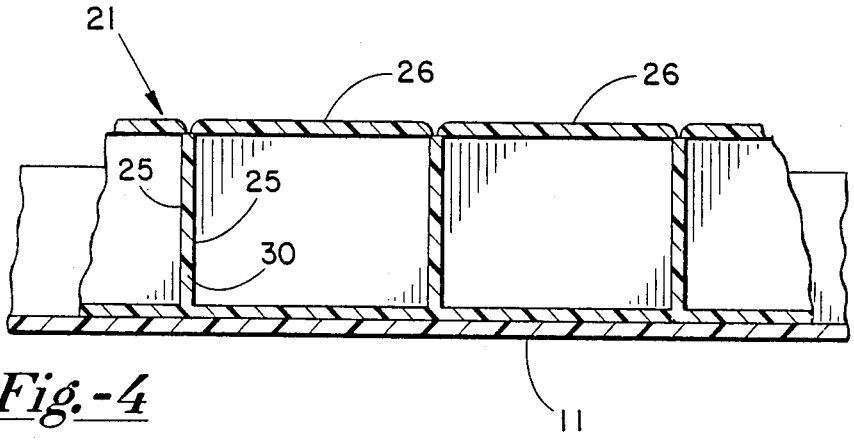

FIG. 4 is a view taken along section line 4—4 of FIG. 2.

DESCRIPTION OF THE PREFERRED EMBODIMENT

A relatively shallow tray or outer container, designated generally by reference numeral 10, which is preferably molded out of some suitable material such as polystyrene has a flat bottom wall 11, upward extending side walls 12 and 13 and upward extending upper wall 14 and lower wall 15 forming an open top enclosure. Extending outward from the top edge of the upper wall 14 is a flange or ledge or panel 16 with indicia or markings 17 equally spaced along the ledge 16 each designating a different day of the week. Each of the day-of-the-week indicia or markings 17 defines a space, generally designated by reference numeral 20, between the upper wall 14 and lower wall 15 for holding a set of pill boxes 21 in line with a marking 17. A series of ribs 19 parallel to the side walls 12 and 13 extend upward from the bottom of the tray with the rib spacing being substantially the same as the spacing designated by the day-of-the-week markings 17.

Each individual pill box 23 in a set 21 is conventional. Preferably like pill box 23 is molded out of a suitable material such as polypropylene and has a closed bottom 24, enclosing side walls 25, and a cover or top 26. Cover 26 is attached by living hinge 27 along the tip edge of one of the side walls and frictionally engages the top edge of the opposite side wall at 28 when closed so that it is held closed but can be easily opened to remove and/or insert contents. The width of each box is substantially equal to the spacings of ribs 19 so that it will fit snugly into the space 20 defined by each of the day-of-the-week markings 17. The height of each box is such that it extends significantly above the upper and lower walls, 14 and 15 respectively, of tray 10 so that it can be easily grasped by the fingers and lifted out of the tray. A series of pill boxes 23 placed end-to-end having a wall attached together or a common wall in some convenient fashion, as shown at 30 in Fig. A to form an elongated set of pill boxes identified by reference number 21. In the embodiment shown and described herein, four pill boxes 23 are joined together to form a set 21. The cover of each pill box is suitably marked with an indication of a certain time of the day at which the content of the box should be taken. In this case, the markings are "morn" (for morning), "noon", "eve" (for evening), and "bed" (for bedtime). The various times of the day can be designated and marked in some other suitable fashion. The sets of pill boxes 21 rest in the spaces 20 and are frictionally held in place by the ribs 19 (along with the side walls 12 and 13 in the case of the outermost sets) and medication prescribed for the given or marked time of day is contained in the individual compartment or pill boxes of the set. At the prescribed time in the designated day of the week the user opens the box, removes and takes the content. If the user is going to be away for a day or two or for part of a day and yet wants or needs to take the medication with him, he merely removes the set of pill boxes 21 for that given day, places it in his pocket or some other convenient carrying place so that he has his medication with him during the day, yet does not have to carry around the entire week's prescribed medication. When he returns, he places the set of pill boxes 21 back into the suitable space 20 in the tray 10 so that the compartments can be refilled. The device is compact, lightweight, inexpensive to manufacture and is simple to use. If any of the pill boxes should be damaged, the set can be inexpensively and easily replaced.

I claim:

1. A pill box holder comprising:

an outer container comprising an open top rectangular tray having a flat bottom and enclosing right, left, upper and lower side walls extending upward from the edges of said bottom;

a flat panel extending outward along the top edge of said upper side wall;

a series of markings equally spaced along said panel, each of said markings designating a different day of the week and defining a corresponding space within said outer container extending between the upper and lower side walls for receiving a set of pill boxes;

an elongated set of identical individual pill boxes attached together end-to-end located in said outer container in each of the spaces defined by said day-of-the-week markings;

each of said pill boxes having a hinged releasably closable cover with indicia designating a time of day imprinted on said cover; and a series of equally spaced ribs parallel to and located between the right and left sidewalls of said outer container extending upward from the bottom of said container for frictionally engaging and releasably holding each of said sets of pills boxes in said outer container within the space defined by said day-of-the-week markings.

* * * * *